United States Patent [19]

Barlow

[11] Patent Number: 5,044,288

[45] Date of Patent: Sep. 3, 1991

[54] METHOD AND APPARATUS FOR THE EFFICIENT COMBUSTION OF A MASS FUEL

[76] Inventor: James L. Barlow, 1524 Ticonderoga Dr., Fort Collins, Colo. 80525

[21] Appl. No.: 508,929

[22] Filed: Apr. 13, 1990

Related U.S. Application Data

[63] Continuation-in-part of Ser. 278,183 Dec. 1, 1988.

[51] Int. Cl.[5] ..... F23G 5/00

[52] U.S. Cl. ..... 110/346; 110/300; 110/341; 110/348

[58] Field of Search ..... 110/291, 289, 298, 299, 110/300, 255, 257, 259, 341, 346, 348, 347

[56] References Cited

U.S. PATENT DOCUMENTS

| | | | |
|---|---|---|---|
| 76,734 | 4/1868 | Fletcher | 110/298 |
| 654,774 | 7/1900 | Wood | 110/298 |
| 1,664,082 | 3/1928 | Mildon | 110/291 |
| 2,073,450 | 3/1937 | Hobson, Jr. | 110/28 |
| 3,334,599 | 8/1967 | Tanner | 110/8 |
| 3,651,770 | 3/1972 | Hotti | 110/8 R |
| 3,812,794 | 5/1974 | Taylor | 110/8 R |
| 3,924,548 | 12/1075 | Du Chambon | 110/8 C |
| 3,937,155 | 2/1976 | Kunstler | 110/18 R |
| 3,955,512 | 5/1976 | Martin | 110/8 R |
| 4,473,013 | 9/1984 | John | 110/235 |
| 4,510,873 | 4/1985 | Shigaki | 110/289 |
| 4,512,266 | 4/1985 | Shigaki | 110/204 |
| 4,528,917 | 7/1985 | Jacobs | 110/300 |
| 4,676,176 | 6/1987 | Bonomelli | 110/281 |

*Primary Examiner*—Edward G. Favors
*Assistant Examiner*—Denise L. F. Gromada
*Attorney, Agent, or Firm*—Luke Santangelo

[57] ABSTRACT

A grate assembly consisting of a means for receiving a mass fuel and combusting the mass fuel on a surface with the addition of a combustion gas, and discharging the remaining residue. A separate means for injection of a mix gas at multiple points along the surface where combustion is occurring. The mix gas enhancing combustion by aiding in the mixing, drying and migration of the mass fuel during the combustion process. Multiple injection means for the introduction of the mix gas along the surface where combustion is occurring and a means for controlling the rate of introduction of the gas at each point. Separate treatment zones also being defined along the surface where combustion is occurring and a means for introduction of combustion gas within each zone and a means for controlling the rate of introduction of combustion gas to each zone.

20 Claims, 2 Drawing Sheets

METHOD AND APPARATUS FOR THE EFFICIENT COMBUSTION OF A MASS FUEL

This is a continuation-in-part of application Ser. No. 07/278,183 filed Dec. 1, 1988 entitled "Incinerator Grate Assembly" and now U.S. Pat. No. 4,955,296.

I. FIELD OF THE INVENTION

The present invention relates generally to furnaces and more particular to stationary incinerator structures and methods having an improved stoker grate and methods for the burning of solid fuels, especially those fuels having widely varying combustion characteristics such as household refuse.

II. BACKGROUND OF THE INVENTION

Although this invention is primarily directed to an improved stationary incinerator structure adapted to utilize solid fuel such as household and industrial waste, it will be understood that any of various types of combustible, particulate materials may serve as the supply fuel feed for the instant apparatus. The term "mass fuel" referred to herein, is intended to mean any matter being combusted while resting on a surface or traveling on or along a surface. This is to be distinguished from the prior art methods in which the matter is purposefully suspended in air a substantial distance above a surface. It is also distinguishable from prior art methods which require the matter to be fragmented before combustion.

The difficulty of burning certain mass fuels such as refuse is well-known. Refuse often includes a high percentage of slow-burning or wet materials which impede combustion and exhibit an erratic burn rate. Furthermore, such compositions vary continuously with the weather, season, area where picked up, conditions under which stored and other uncontrollable and unpredictable variables.

One known method of burning refuse is to divide the incinerator grate into two or three separate treatment zones and, through plenum chambers, provide combustion air under differing parameters to each one, thereby varying the characteristics of the air to suit the combustion needs. Thus, the air in the first zone containing fresh unburned refuse may be heated to dry out the trapped moisture, with combustion possibly not commencing until the refuse has entered the next zone, which is supplied with a different air mix.

Control of combustion in the various zones is generally limited to varying the characteristics of the air flowing to each zone. However, as the thickness of the refuse layer and its characteristics are generally not uniform across any one zone, burning time is longer, dictated by the slowest burning area on the grate.

It is, therefore, desirable to divide the grate surface into more zones and to provide means for independently controlling the combustion in each zone. Furthermore, the control should be as automatic as possible, so that each zone can be monitored and adjusted continuously, in an effort to maximize the efficiency of the burning to obtain the greatest throughput, be it solely an objective to dispose of an input feed material, or alternately to produce a source of energy, such as heated air, water or steam from the burning operation. Optimal burn efficiency is believed to be achieved only by the simultaneous mix and burn method previously known to those skilled in the art, but may be performed in a variety of manners.

It is also desirable to provide a means for mixing, or agitating the fuel during the combustion process. This mixing will enhance combustion by exposing all material to be combusted on the stationary surface where combustion is occurring. The result is such that the overall combustion efficiency is improved. One method used by those skilled in the art for performing this task prior to the present invention has been to design a stepped grate, whereby a part or all of the steps move in a fashion which in turn aids in the overall mixing and travel of the fuel in a predominant direction. This is in sharp contrast to the present invention which utilizes a stationary grate surface.

Another previously known means to accomplish the mixing is with the combustion air being fed through the grate assembly. However, the use of combustion air for this dual purpose presents problems that until the present invention were unseen by those skilled in the art. The problem was that while controlling combustion as well as enhancing the combustion through the mixing 10 of the fuel, neither of the tasks were optimized. Hence, while maintaining the required combustion air to support the overall combustion process, the specific requirements needed for the mixing may be neglected. Similarly, while maintaining the requirements needed to perform the mixing of the fuel, the necessary requirements for the proper oxygen-to-fuel ratio may be neglected either with too much or too little air. Combined with the need to adjust to varying fuel conditions in many cases, the ability to perform both tasks is virtually impossible. Therefore, a means for accomplishing both tasks in a fashion in which neither of these requirements are neglected would provide a drastic improvement in the overall combustion process.

For purposes of discussion, the term "combustion gas" referred to herein shall mean any gas such as atmospheric air or combustion air which contains similar or sufficient quantities of oxygen to support a combustion process.

III. DESCRIPTION OF THE RELATED ART

The prior art burners and incinerators for combustion of solid fuels and particularly refuse, have recognized the nonhomogeneous nature of many fuels, their high percentage of noncombustibles, and their changing combustion requirements as they proceed from the raw state upon grate entry to final ash form at discharge.

A variety of installations have been proposed to control the combustion airflow to effect better control of the combustion process. U.S. Pat. No. 2,072,450 illustrates the burning of finely-divided or crushed fuel which is preheated on a sloping grate and traverses by gravity until blown upwards and backwards by a combustion gas to assist in the burning of subsequently introduced fuel.

U.S. Pat. No. 3,334,599 discloses a furnace having separate grates for pre-drying and combustion of fuel using preheated air for drying and unheated air for combustion.

U.S. Pat. No. 3,651,770 discloses a mechanical grate which raises or agitates burning fuel to assure complete combustion.

U.S. Pat. No. 3,924,548 discloses an incinerator for refuse having a stationary grate provided with a plurality of combustion zones, individual wind boxes and controllable air supplies for each zone, whereby the fuel is agitated, lifted and transported by the combustion gas.

However, nothing in the known prior art suggests the presently proposed construction method for flowing both a primary combustion gas and a secondary mix gas into the same combustion zone, the mix gas flow characteristics being controlled entirely separately from those of the primary, according to the existing combustion characteristics at each point along the surface where the combustion process is being completed.

IV. SUMMARY OF THE INVENTION

An object, advantage and feature of the present invention is to provide a novel means to improve the speed of response and flexibility in the control of combustion of mass fuels by injecting a secondary mix gas into the fuel mass to lift, agitate, dry and control the migration of the fuel during the combustion process. It is further an object to accomplish the aforementioned improvement without the need for a moving apparatus associated with the grate assembly, either in whole or in part, and thus allowing the grate to be "stationary". It is still a further object to accomplish the aforementioned improvement without adversely affecting the combustion process with the addition of significant excess oxygen, such as atmospheric air.

A further object of the present invention is to provide a mix gas injection means with a plurality of injection points and a means to independently control the rate of delivery of the gas flow at each point. Thus, with control of the velocity of the mix gas at each point where it is released into the fuel, a force which is virtually unlimited is available for performing the tasks of mixing, drying and controlling the migration rate of the material.

Another object of the present invention is to allow for directional orientation of the release of the mix gas at each point of release, such that the tasks of mixing, drying and transporting the material are optimized. The direction of the release supplying a perpendicular and/or one of two tangential components to the predominate direction of the fuel travel on or along the surface.

Another object is to provide a plurality of treatment zones with each zone having a separate means for the introduction of combustion gas and independent rate control means of delivery of combustion gas.

These, together with other objects and advantages of the invention, reside in the details of the process and the operation thereof as is more fully hereinafter described and claimed. References are made to drawings forming a part hereof, wherein like numerals refer to like parts throughout.

V. BRIEF DESCRIPTION OF THE DRAWINGS

VI. DESCRIPTION OF THE PREFERRED EMBODIMENT

Figure 1:
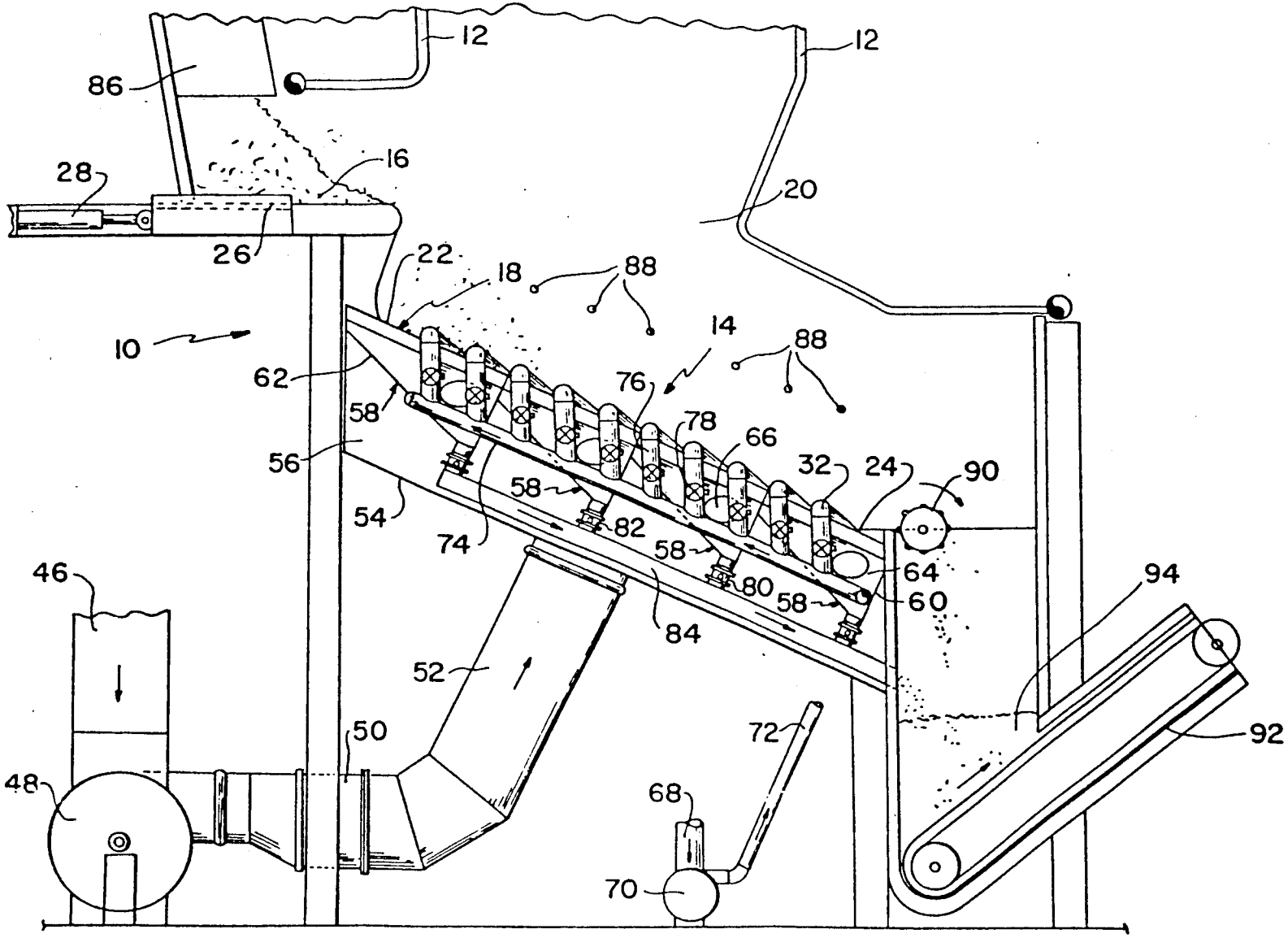
FIG. 1 is at side view illustrating the grate assembly according to the present invention.

Referring now to the drawings, particularly FIG. 1, the present invention will be seen to relate to a furnace or incinerator, generally designated by numeral 10 and which may be employed for the primary purpose of merely incinerating an input feed product or, of utilizing an input feed to generate another source of energy, such as hot air, heated water or steam. In this respect, peripheral housing or walls (12) of the furnace may be configured in any suitable well-known manner according to the intended use of the furnace.

Most specifically, the present invention is directed to the construction of grate assembly (14) serving to receive and dispose of mass fuel or feed material (16) during a combustion process. Combustion process refers to the procedure of receiving a fuel and combusting the fuel to produce a heat release and subsequent combusted material, typically in the form of ash. It is preferable that this process take place substantially on the surface of grate assembly (14). That is, the suspension of the combusting fuel is minimized in order to maintain complete and efficient combustion of all the supplied mass fuel. The fuel may comprise any suitable material such as household or industrial refuse and which often will vary in its physical and chemical properties. An important advantage of the present apparatus is that numerous types of particulate, solid or semi-solid materials exhibiting a wide range of parameters, are readily accommodated by instant grate assembly (14) with its attendant control system, such that optimum burning is achieved with minimum residue or ash remaining to be disposed of.

Grate assembly (14) will be seen to comprise an inclined upper table (18) spanning the breadth of furnace chamber (20) and having its input feed end (22) mounted substantially above the elevation of a discharge end (24). Input end (22) is adapted to receive refuse or other feed material (16), as delivered by suitable apparatus, such as feed table (26) associated with appropriate actuating means as reflected by flow regulating device (28) in FIG. 1. With feed table (26) positioned beneath a feed chute, it will follow that by regulating the operation of cylinder (28) and its connected table (26), the volume of input feed material (16) delivered to input end (22) of grate table (18) may be controlled.

Figure 2:
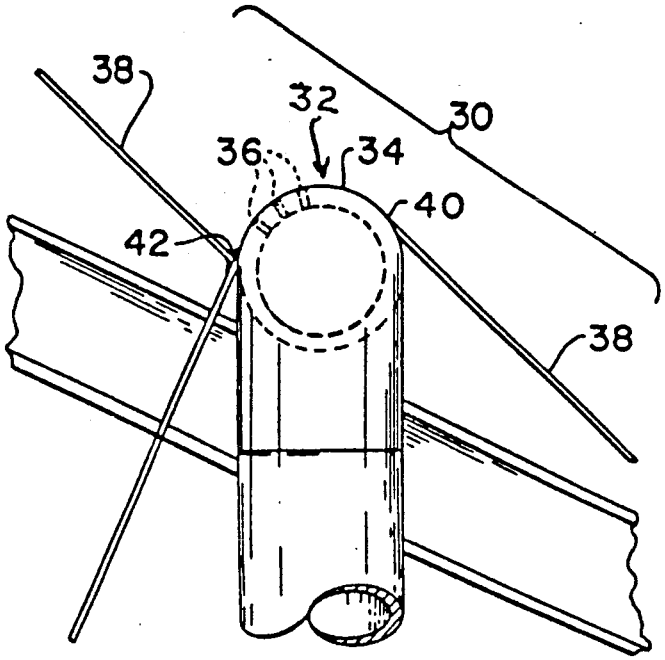
FIG. 2 is an enlarged end elevation of one end of a mix gas delivery tube.

Self-stoking of the feed material deposited upon upper input end (22) of fixedly mounted grate table (18) is achieved by a unique construction of the table and distribution of both combustion gas and mix gas to the feed material thereon. Table (18) comprises a plurality of sequentially disposed grate segments (30), shown most clearly in FIGS. 2–3 and each including a transversely extending gas delivery tube (32) having a semicircular upper surface (34) provided with a plurality of mix gas supply nozzles or apertures (36). Mix gas supply nozzles or apertures (36) are directed, in this embodiment, in a manner such that when the mix gas is admitted it has a component which is focused in an upstream direction, with respect to the inclination of grate assembly (14). The term "component" used herein with reference to the mix gas relates to the directional constituents of a resultant force vector created by the release of the mix gas into fuel (16). The components of concern are the perpendicular, which occurs at a 90° angle to the overall inclination of grate assembly (14), and the tangential, which may occur at either 0° or 180° to the inclination of grate assembly (14). This means, in essence, as it is implicitly stated in the later claims, mix gas supply nozzles or apertures (36) may be directed at any angle within the 180° arc spanning the length of grate assembly (14). Naturally, in some applications nozzles or apertures (36) may be directed in such a manner as to have components focused laterally across grate assembly (14). Extending in a downstream direction from each tube (32) is a substantially planar grate plate (38)

having an upper end (40) tangent to the constant radius curvature of tube (32) and which is mounted at an inclination of approximately 45 degrees. Lower end (42) of plate (38) is attached to the next lower gas delivery tube (32) at a level which is below its gas nozzles (36) such that an included angle of preferably less than 90 degrees is formed therewith. In this manner, a definite abutment will be seen to be formed at lower end (42) of grate plates (38) such that any feed material (16) received on any plate (38) will be at least initially retained thereupon.

Figure 3:
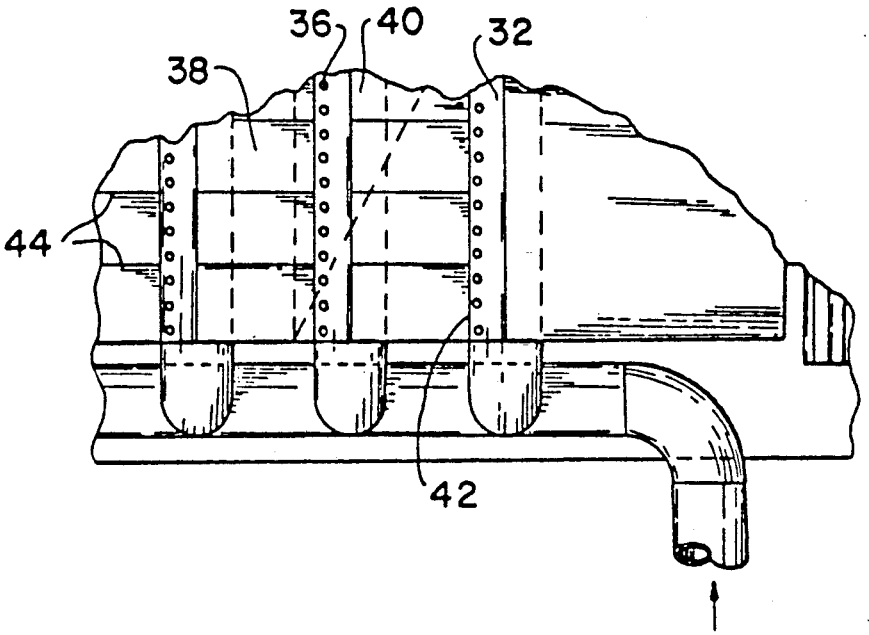
FIG. 3 is a fragmentary top plan of the grate assembly table.

As illustrated in FIG. 3, each grate plate (38) is provided with a plurality of apertures, preferably parallel longitudinally extending slots (44) and which provide means for the release of combustion gas into feed material on the grate plates. It is preferred that the combustion gas and the mix gas be admitted through separate interleaved locations along grate assembly (14). This means there are sections containing both mix gas supply nozzles (36) and combustion air plenums (56) for the purpose of mixing and combusting the mass fuel. The gas for supporting combustion is drawn from a furnace exterior source (46) by means of a controllable fan (48) and directed through a preheater (50) which may receive its heat from the very output generated by stoker grate (14) of the present invention. A combustion air duct (52) leads upwardly and through bottom wall (54) of a main combustion air plenum (56) which will be seen to extend beneath entire table (18) of grate assembly (14). Mounted within the confines of main plenum (56) are a plurality of adjacent, undergrate combustion air plenums (58), each enclosing the area beneath a plurality of grate segments (30). Each plenum (58) includes a depending front wall (60) and an inclined bottom wall (62) bounded by sidewalls (64). At least one controllable damper (66) in the walls of each undergrate plenum (58) allows the regulated admission of combustion air from primary, supply plenum (56), which air is then directed upwardly through the plurality of grate plate slots (44) to support combustion atop table (18) as will be described in detail hereinafter.

Mix gas shall mean any gas suitable for mixing, agitating, drying and controlling the migration of a mass fuel and thereby conditioning the mass fuel without significantly supporting the combustion process as would a combustion gas. The elements of combustion being fuel, heat and oxygen, it is preferable that the mix gas supply none of these and thereby not support combustion, but rather it should ensure sufficient communication between these elements to enhance combustion. The mix gas is entirely separate from the essential supply of combustion air. This gas is received from a supply line (68) and forced by a controllable fan or blower (70) through mix gas input line (72) to mix gas supply header (74) extending longitudinally to serve all of gas delivery tubes (32) as shown in FIGS. 1 and 3. Naturally, various inert gases may be supplied by a separate means, such as a compressed gas canister, to accomplish the goals set forth by the present invention. Mix gas riser (76) provides communication between header (74) and end of each tube (32) and each riser (76) will be seen to be provided with a suitable mix gas control valve (78). In this manner, the pressure and volume of mix gas as issuing from nozzles (36) of any one of delivery tubes (32) may be individually regulated and may even vary over time, such as might be necessary for mixing a mass fuel having varying conditions. As an example, a relatively high pressure admittance of mix gas may be required for heavier mass fuel.

Undergrate plenums (58) will be understood to serve a dual purpose. In addition to supplying combustion air through slots (44) in grate plates (38), smaller ash particles which may fall through these slots are directed to the lowest point within respective plenums (56) and thence fall into ash tube (80). This tube is provided with controllable damper (82) allowing the regulated passage of ash siftings from ash tube (80) into a connected, common, inclined ash manifold duct (84).

With the above structure in mind, the operation of the grate assembly may now be described. Input feed (16), such as received from an appropriate input chute (86), is delivered to feed table (26) whereafter it is directed, upon operation of actuating means (28), to elevated, input end (22) of stoker grate table (18). With combustion air fan (48) operating, input air is preheated at (50) and urged upwardly through duct (52) and into primary combustion air supply plenum (56). Combustion air is then directed, through control dampers (66), into respective undergrate plenums (58). At the same time, mix gas as forced into supply header (74), is admitted into each of delivery tubes (32) in accordance with the regulation of respective control valves (78). This mix gas is thence issued from the plurality of upwardly and rearwardly facing nozzles (36) and combines with the combustion air issuing from grate plate slots (44) to complete the requirements for ignition and the subsequent burning of refuse or feed material (16).

During the above operation, as sequential charges of refuse are pushed onto input end (22) of the grate table, this action forces refuse from the previously deposited charge to move downwardly over the steps or abutments presented by elevated tubes (32). Naturally, in the event that a horizontal grate assembly (14) is utilized, or in unique circumstances utilizing an inclined grate assembly (14) the fuel material may be moved along the surface in a predetermined, predominant direction other than downward. The inclination of grate plates (38), which is greater than that of grate assembly (14) itself, permits gravity to encourage a certain amount of downward progression of the burning feed charge. For this reason it is unnecessary to advance material by actuating the grate plates themselves; the material is transported not through an affirmative action, but rather through an interaction of various factors present in the design. The preferred design utilizes a stationary grate assembly (14) which is more reliable and requires less maintenance thereby saving valuable money. However, several factors will affect the burn rate at each of grate segments (30). The action of loading a fresh fuel charge materially, alters the combustion requirements at each grate segment (30), as the fuel on each step will exhibit its own combustion requirements, and these parameters will change continuously as feeding and combustion proceeds. It will be appreciated that the volume, density and other characteristics of the charge at any one grate segment (30) will be constantly changing. Sensor means (88) of any suitable well-known type are appropriately positioned throughout the apparatus and serve to detect these changes, signaling the need for combustion air adjustments by regulation of dampers (66), as well as regulation of mix gas valves (78). Automatic stoking of deposited feed material (16) and an optimum burn thereof will thus be understood to be precisely regulated in a manner leading to a vastly improved operation. The variable volume of issuance of the mix gas not only allows attainment of optimum combustion affecting the feed material but also enhances the progressive migration of the feed from one end of grate table (18) to the other end. This will be apparent when it is realized that the force created by the release of the mix gas being directed from the plurality of tube nozzles (36) will lift up feed material overlying or upstream of those nozzles, thereby agitating, advancing and enhancing the burn thereof.

With proper regulation of combustion air dampers (66) and mix gas valves (78), a maximum burn of the feed material is achieved before any of the feed can reach discharge end (24) of the table. At this discharge end, the remaining residue will be delivered to a containment area such as lowermost ash pit (94) by means of a driven ash discharge roller (90). An appropriate ash discharge conveyor (92) is thence operated to remove such unburned material from ash pit (94) to a collection point external of furnace wall (12). Ash pit (94) would be waterfilled to provide a suitable seal between furnace wall (12) and the outside atmosphere.

All of the aforementioned constituents and functional aspects of the present invention are those of preferable embodiments only. Many of these constituents and functional aspects may be accomplished in other manners which are not discussed above, or shown in the drawings, because they are too numerous to mention, but are considered to fall within the scope of the present invention. Particularly with respect to the claims it should be understood that changes may be made without departing from their essence. In this regard it is intended that such changes would still fall within the scope of the present invention. In no way should any lists of possible alternatives be considered exhaustive, but rather inclusive of any newly devised means for accomplishing the novel aspects of this invention. It simply is not practical to describe and claim all possible revisions to the present invention which may be accomplished. To the extent such revisions utilize the essence of the present invention, each would naturally fall within the breadth of protection encompassed by this patent.

I claim:

1. A method for the efficient incineration of combustible mass fuel comprising the steps of:

a. receiving said combustible mass fuel; then
b. directing said mass fuel to a surface for combustion; then
c. admitting a combustion support gas to said combustible mass fuel while it is situated on said surface; while
d. combusting said mass fuel as it is situated on said surface to produce combusted material; while
e. mixing said mass fuel by introducing a separate mix gas into said mass fuel wherein said separate mix gas does not significantly support combustion; while
f. transporting said combustible mass fuel along said surface in a predominant direction; and then
g. advancing the combusted material towards a containment area.

2. A method for the efficient incineration of combustible mass fuel as described in claim 1 and further comprising the step of directing said separate mix gas in a direction having a component perpendicular to the predominant direction in which said combustible mass fuel is transported, said step of directing the separate mix gas being performed while accomplishing the step of admitting the separate mix gas.

3. A method for the efficient incineration of combustible mass fuel as described in claim 2 and further comprising the step of directing said separate mix gas in a direction having a component tangential to the predominant direction in which said combustible mass fuel is transported, said step of directing the separate mix gas being performed while accomplishing the step of admitting the separate mix gas.

4. A method for the efficient incineration of combustible mass fuel as described in claim 2 and further comprising the step of directing said separate mix gas in a direction laterally across the predominant direction in which said combustible mass fuel is transported, said step of directing the separate mix gas being performed while accomplishing the step of admitting the separate mix gas.

5. A method for the efficient incineration of combustible mass fuel as described in claim 2 wherein said combustion support gas and said separate mix gas are admitted at a rate and further comprising the step of adjusting said rates independent of each other.

6. A method for the efficient incineration of combustible mass fuel as described in claim 4 wherein said combustion support gas and said separate mix gas are admitted at a rate and further comprising the step of adjusting said rates independent of each other.

7. A method for the efficient incineration of combustible mass fuel as described in claim 6 wherein said combustion support gas and said separate mix gas are admitted in separate interleaved locations along said surface.

8. A method for the efficient incineration of combustible mass fuel as described in claim 4 wherein said separate mix gas is admitted at a rate and wherein said step of admitting said separate mix gas comprises the step of varying the rate at which said separate mix gas is admitted over time.

9. A method for the efficient incineration of combustible mass fuel as described in claim 7 wherein said separate mix gas is admitted at a rate and wherein said step of admitting said separate mix gas comprises the step of varying the rate at which said separate mix gas is admitted over time.

10. A method for the efficient incineration of combustible mass fuel as described in claim 2 wherein said surface on which combustion occurs is horizontal.

11. A method for the efficient incineration of combustible mass fuel as described in claim 2 wherein said surface on which combustion occurs is inclined downward in the predominant direction in which said combustible mass fuel is transported.

12. A method for the efficient incineration of combustible mass fuel as described in claim 6 wherein said surface on which combustion occurs is inclined downward in the predominant direction in which said combustible mass fuel is transported.

13. A method for the efficient incineration of combustible mass fuel as described in claim 9 wherein said surface on which combustion occurs is inclined downward in the predominant direction in which said combustible mass fuel is transported.

14. A method for the efficient incineration of combustible mass fuel as described in claim 1 wherein said surface on which combustion occurs is stationary.

15. A method for the efficient incineration of combustible mass fuel as described in claim 2 wherein said surface on which combustion occurs is stationary.

16. A method for the efficient incineration of combustible mass fuel as described in claim 5 wherein said surface on which combustion occurs is stationary.

17. A method for the efficient incineration of combustible mass fuel as described in claim 6 wherein said surface on which combustion occurs is stationary.

18. A method for the efficient incineration of combustible mass fuel as described in claim 11 wherein said surface on which combustion occurs is stationary.

19. A method for the efficient incineration of combustible mass fuel as described in claim 5 and further comprising the steps of:

a. dividing said surface into separate treatment zones; then b. admitting said combustion support gas into each of said treatment zones wherein said combustion support gas is admitted at rates independent of each other among each treatment zone; while c. admitting said separate mix gas into each of said treatment zones; wherein said separate mix gas is admitted at rates independent of each other among each treatment zone; while d. adjusting said independent rates to optimize the combustion process according to the characteristics of the particular combustible mass fuel utilized.

20. A method for the efficient incineration of combustible mass fuel as described in claim 12 and further comprising the steps of a. dividing said surface into separate treatment zones; then b. admitting said combustion support gas into each of said treatment zones wherein said combustion support gas is admitted at rates independent of each other among each treatment zone; while c. admitting said separate mix gas into each of said treatment zones; wherein said separate mix gas is admitted at rates independent of each other among each treatment zone; while d. adjusting said independent rates to optimize the combustion process according to the characteristics of the particular combustible mass fuel utilized.

* * * * *